United States Patent [19]

Mudge et al.

[11] Patent Number: 4,942,086

[45] Date of Patent: Jul. 17, 1990

[54] TWO-STAGE HEAT RESISTANT BINDERS FOR NONWOVENS

[75] Inventors: Paul R. Mudge, Belle Mead; James J. Walker, Whitehouse Sta.; Ronald Pangrazi, Flemington, all of N.J.

[73] Assignee: National Starch and Chemical Investment Holding Corporation, Wilmington, Del.

[21] Appl. No.: 242,763

[22] Filed: Sep. 9, 1988

[51] Int. Cl.[5] ..... B05D 3/00; B32B 11/04; B32B 11/10; B32B 27/30; E04D 5/02

[52] U.S. Cl. ..... 428/290; 427/389.9; 427/392; 428/291; 428/489; 428/507; 428/510; 428/514

[58] Field of Search ..... 427/389.9, 392; 428/290, 291, 489, 507, 510, 514

[56] References Cited

U.S. PATENT DOCUMENTS

| | | | |
|---|---|---|---|
| 2,754,280 | 7/1956 | Brown et al. . | |
| 2,795,564 | 6/1957 | Conn et al. . | |
| 3,671,610 | 6/1972 | Amagi et al. . | |
| 3,732,184 | 5/1973 | Lindemann et al. . | |
| 3,833,404 | 9/1974 | Sperling et al. . | |
| 3,967,032 | 6/1976 | Plotz et al. . | |
| 4,539,254 | 9/1985 | O'Connor et al. | 428/300 |
| 4,599,258 | 7/1986 | Hageman | 428/140 |
| 4,616,057 | 10/1986 | Lindemann et al. | 524/458 |
| 4,859,508 | 8/1989 | Pangrazi et al. | 427/389.9 |

FOREIGN PATENT DOCUMENTS 187505 7/1986 European Pat. Off. .

OTHER PUBLICATIONS

"Method of Evaluating Heat Resistance of Polymers Through Thermomechanical Analysis", M. E. Yannich and R. Pangrazi; 1986 TAPPI Proceedings; 1986 Nonwovens Conference.

*Primary Examiner*—James C. Cannon

*Attorney, Agent, or Firm*—Ellen T. Dec; Edwin M. Szala

[57] ABSTRACT

Heat resistance binders for flexible polyester webs may be prepared using an emulsion polymer,the polymer being prepared by a two-stage polymerization procedure wherein a first stage is prepared based on a relatively low Tg ethylene vinyl acetate polymer and a second stage higher Tg polymer thereby combining the advantageous flexibility and film forming properties of the ethylene vinyl acetate copolymer with the stiffness and heat resistance of the higher Tg copolymer.

15 Claims, No Drawings

TWO-STAGE HEAT RESISTANT BINDERS FOR NONWOVENS

BACKGROUND OF THE INVENTION

The present invention is directed to binders for use in the formation of nonwoven products to be utilized in areas where heat resistance is important. Such products find use in a variety of applications including as components in roofing, flooring and filtering materials.

Specifically, in the formation of asphalt-like roofing membranes such as those used on flat roofs, polyester webs or mats about one meter in width are formed, saturated with binder, dried and cured to provide dimensional stability and integrity to the webs allowing them to be used on site or rolled and transported to a converting operation where one or both sides of the webs are coated with molten asphalt. The binder utilized in these webs plays a number of important roles in this regard. If the binder composition does not have adequate heat resistance, the polyester web will shrink when coated at temperatures of 150-250° C. with the asphalt. A heat resistant binder is also needed for application of the roofing when molten asphalt is again used to form the seams and, later, to prevent the roofing from shrinking when exposed to elevated temperatures over extended periods of time. Such shrinking would result in gaps or exposed areas at the seams where the roofing sheets are joined as well as at the perimeter of the roof.

Since the binders used in these structures are present in substantial amounts, i.e., on the order of about 25% by weight, the physical properties thereof must be taken into account when formulating for improved heat resistance. Thus, the binder must be strong enough to withstand the elevated temperatures but must also be flexible at room temperature so that the mat may be rolled or wound without cracking or creating other weaknesses which could lead to leaks during and after impregnation with asphalt.

Binders for use on such nonwoven products have conventionally been prepared from (meth)acrylate or styrene/acrylate copolymers containing N-methylol functionality. Other techniques for the production of heat resistant roofing materials include that described in U.S. Pat. No. 4,539,254 involving the lamination of a fiberglass scrim to a polyester mat thereby combining the flexibility of the polyester with the heat resistance of the fiberglass.

It would be desirable to provide more economical binders by incorporating substantial amounts of less expensive raw materials such as ethylene vinyl acetate polymers but without sacrificing the heat resistance properties of the acrylate or styrene/acrylate based binders.

SUMMARY OF THE INVENTION

Heat resistant binders for flexible polyester webs may be prepared using an emulsion polymer, the polymer being prepared by a two-stage polymerization procedure wherein a first stage is prepared based on a relatively low Tg ethylene vinyl acetate polymer and a second stage higher Tg polymer thereby combining the advantageous flexibility and film forming properties of the ethylene vinyl acetate copolymer with the stiffness and heat resistance of the higher Tg copolymer.

These binders are more economical then those previously available and yet exhibit an exceptionally high degree of heat resistance and, as such, are useful in the formation of heat resistant flexible webs or mats for use in roofing, flooring and filtering materials.

DETAILED DESCRIPTION OF THE PREFERRED EMBODIMENTS

The two stage polymerization utilized herein may be carried out using a variety of specific modifications which are generally referred to as producing "core-shell" or "interpenetrating network" type polymers. Such polymerization procedures are described, for example, in U.S. Pat. Nos. 3,671,610; 3,833,404; and 4,616,057, the disclosures of which are incorporated herein by reference.

More specifically, an ethylene vinyl acetate polymer containing both pre- and post-crosslinking monomers is prepared using conventional batch, semi-batch or continuous emulsion polymerization procedures such as taught in U.S. Pat. Nos. 2,754,280; 2,795,564 and 3,732,184. The amounts of ethylene and vinyl acetate may vary within a range of about 10 to 25% by weight ethylene and 70 to 90% vinyl acetate with the amounts chosen so as to provide a first-stage polymer having a Tg of −10 to +15° C.

The acrylate ester or styrene/acrylic monomers which comprise the major portion of the second stage copolymer should be selected to have a Tg within the range of +50 to +120° C., preferably about 80 to 100° C. The acrylate esters used in the copolymers described herein the alkyl acrylates or ethylenically unsaturated esters of acrylic or methacrylic acid containing 1 to 4 carbon atoms in the alkyl group including methyl, ethyl, propyl and butyl acrylate. The corresponding methacrylate esters may also be used as may mixtures of any of the above. Suitable copolymers within this Tg range may be prepared, for example, from copolymers of $C_1$–$C_4$ acrylates or methacrylates with methyl methacrylate or other higher Tg methacrylates. The relative proportions of the comonomers will vary depending upon the Tg of the specific acrylate(s) or methacrylate employed. It will also be recognized that other comonomers, such as styrene or acrylonitrile, which are sometimes used in emulsion binders, may also be present in conventional amounts and at levels consistant with the desired Tg range.

In addition to the ethylene/vinyl acetate and higher Tg monomers, both a pre-crosslinking monomer and a post-crosslinking monomer should be present in each stage of the polymerization.

The pre-crosslinking or "active crosslinking" monomer is one which provides immediate crosslinking and branching of the polymer during the initial formation of the emulsion polymer. Monomers of this type generally comprise compounds which contain 2 to 5 ethylenically unsaturated groups in one molecule separated by an ester or ether group, or by an aromatic or nitrogenous ring structure, where the unsaturated groups are capable of undergoing additional polymerization by free radical means. Suitable active crosslinking agents include alkylene glycol diacrylates and methacrylates, such as ethylene glycol diacrylate, 1,3-butylene glycol diacrylate, propylene glycol diacrylate, triethylene glycol dimethacrylate etc., 1,3-glycerol dimethacrylate, 1,1,1-trimethylol propane dimethacrylate, 1,1,1-trimethylol ethane diacrylate, pentaerythritol trimethacrylate, sorbitol pentamethacrylate, methylenebisacrylamide, methylene bismethacrylamide, divinyl benzene, vinyl methacrylate, vinyl crotonate, vinyl acrylate, divinyl adipate; also di- and tri-allyl compounds, such as triallyl cyanurate, triallyl isocyanurate, diallyl phthalate, allyl methacrylate, allyl acrylate, diallyl maleate, diallyl fumarate, diallyl itaconate, diallyl malonate, diallyl carbonate, triallyl citrate, triallyl aconitate; also divinyl ether, ethylene glycol divinyl ether and the like. The amount of active crosslinking agent in each stage of the polymer emulsion of the present invention may vary from about 0.01 to 0.5 percent, preferably from about 0.05 to 0.25 percent by weight of the polymer.

The post-crosslinking monomer, also referred to as a "latent crosslinking" monomer is a polyfunctional monomer wherein a portion of the functionality enters into the polymerization with other monomers in the polymer emulsion, with the residual functionality causing crosslinking of the polymer upon the subsequent application of energy generally by applying heat, e.g. by drying and curing of the latex particles, often in the presence of a catalyst, or by applying radiation. The latent crosslinking agent provides thermosetting characteristics to the polymer emulsion. Upon the subsequent application of energy the latent crosslinking agent forms an insoluble crosslinking network, with the crosslinking being triggered generally by heat or radiation after the polymer emulsion has been formed and applied. Examples of latent crosslinking agents are: N-alkylolamides of alpha, beta ethylenically unsaturated carboxylic acids having 3-10 carbons, such as N-methylol acrylamide, N-ethanol acrylamide, N-propanol acrylamide, N-methylol methacrylamide, N-ethanol methacrylamide, N-methylol maleamide, N-methylol maleamide, N-methylol maleamic acid, N-methylol maleamic acid esters; the N-alkylol amides of the vinyl aromatic acids, such as N-methylol-p-vinylbenzamide and the like; also N-(alkoxymethyl) acrylates and methacrylates, where the alkyl group has from 1–8 carbon atoms, such as N-(methoxymethyl) acrylamide, N-(butoxymethyl) acrylamide, N-(methoxymethyl) methacrylamide, N-(butoxymethyl) allyl carbamate and N-(methoxymethyl) allyl carbamate, and mixtures of these monomers with allyl carbamate, acrylamide or methacrylamide.

Olefinically unsaturated acids may also be employed in either stage of the polymerization to improve adhesion to the polyester web and contribute some additional heat resistance. These acids include the alkenoic acids having from 3 to 6 carbon atoms, such as acrylic acid, methacrylic acid, crotonic acid; alkenedioic acids, e.g., itaconic acid, maleic acid or fumaric acid or mixtures thereof in amounts sufficient to provide up to about 4 parts, preferably 0.5 to 2.5 parts, by weight of monomer units per 100 parts of the acrylate monomers.

In addition, certain copolymerizable monomers which assist in the stability of the copolymer emulsion, e.g., vinyl sulfonic acid and 2-acrylamido-2-methylpropane sulfonic acid are used herein as latex stabilizers. These stabilizers are added in amounts of from about 0.2 to 3% by weight of the monomer mixture.

Conventional batch, semi-batch or continuous emulsion polymerization procedures may be utilized herein. Generally, the monomers are polymerized in an aqueous medium under pressures not exceeding 100 atmospheres in the presence of a catalyst and at least one emulsifying agent.

The quantity of ethylene entering into the copolymer is influenced by the pressure, the agitation, and the viscosity of the polymerization medium. Thus, to increase the ethylene content of the copolymer, higher pressures are employed. A pressure of at least about 10 atmospheres is most suitably employed. The mixture is thoroughly agitated to dissolve the ethylene, agitation being continued until substantial equilibrium is achieved. This generally requires about 15 minutes. However, less time may be required depending upon the vessel, the efficiency of agitation, the specific system, and the like.

Suitable as polymerization catalysts are the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, ferrous salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion.

The free-radical-formers can be charged in the aqueous emulsifier solution or be added during the polymerization in doses.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, aldehydes, chloroform, ethylene chloride and trichloroethylene, can also be added in some cases.

The emulsifying agents are those generally used in emulsion polymerization, as well as optionally present protective colloids. It is also possible to use emulsifiers alone or in mixtures with protective colloids.

The emulsifiers can be anionic, cationic, nonionic surface-active compounds or mixtures thereof. Suitable anionic emulsifiers are, for example, alkyl sulfonates, alkylaryl sulfonates, alkyl sulfates, sulfates of hydroxyalkanols, alkyl and alkylaryl disulfonates, sulfonated fatty acids, sulfates and phosphates of polyethyoxylated alkanols and alkylphenols, as well as esters of sulfosuccinic acid. Suitable cationic emulsifiers are, for example, alkyl quaternary ammonium salts, and alkyl quaternary phosphonium salts. Examples of suitable non-ionic emulsifiers are the addition products of 5 to 50 mols of ethylene oxide adducted to straight-chained and branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. When combinations of emulsifying agents are used, it is advantageous to use a relatively hydrophobic emulsifying agent in combination with a relatively hydrophilic agent. The amount of emulsifying agent is generally from about 1 to about 10, preferably about 2 to about 8, weight percent of the monomers used in the polymerization.

The emulsifier used in the polymerization can also be added, in its entirety, to the initial charge to the polymerization zone or a portion of the emulsifier, e.g. from 90 to 25 percent thereof, can be added continuously or intermittently during polymerization.

Various protective colloids may also be used in place of or in addition to the emulsifiers described above. Suitable colloids include partially acetylated polyvinyl alcohol, e.g., up to 50 percent acetylated, casein, hydroxyethyl starch, carboxymethyl cellulose, gum arabic, and the like, as known in the art of synthetic emulsion polymer technology. In general, these colloids are used at levels of 0.05% to 4% by weight based on the total emulsion.

The polymerization reaction is generally continued until the residual vinyl acetate, monomer content is below 1%. The completed reaction product is then allowed to cool to about room temperature, while sealed from the atmosphere.

To the above described ethylene vinyl acetate copolymer is added a second monomeric system comprising acrylate or styrene/acrylate monomers together with pre- and post-crosslinking agents therefor.

The ratio of the first stage polymer to the second stage polymer may vary from about 6:1 to 2:1 and is preferably in the range of 3:1.

The pre- and post-crosslinking agents useful in the second stage polymerization are the same classes of monomers described previously. For convenience of cure, it may be desirable to use the same crosslinking agents in both stages of the polymerization, it is not required and different monomers may be employed.

All of the second monomeric mixtures may be added directly to the first polymer emulsion and the second polymerization begun or the second monomeric mixture may be added gradually as the polymerization reaction proceeds.

The latices are produced and used at relatively high solids contents, e.g. up to about 60%, although they may be diluted with water if desired. The preferred latices will contain about from 45 to 55, and, most preferred about 50% weight percent solids.

The binders may be used in any conventional nonwoven manufacturing operation. For example, the polyester fibers may be collected as a web or mat using spun bonded, needle punched, entangled fiber, card and bond or other conventional techniques for nonwoven manufacture. When used for roofing membranes, the resultant mat preferably ranges in weight from 10 grams to 300 grams per square meter with 75 to 150 grams being more preferred and 125 to 175 considered optimal. The mat may, for example, then be soaked in an excess of binder emulsion to insure complete coating of fibers with the excess binder removed under vacuum or pressure of nip/print roll. The polyester mat is then dried and the binder composition cured preferably in an oven at elevated temperatures of at least about 150° C. Alternatively, catalytic curing may be used, such as with an acid catalyst, including mineral acids such as hydrochloric acid; organic acids such as oxalic acid or acid salts such as ammonium chloride, as known in the art. The amount of catalyst is generally about 0.5 to 2 parts by weight per 100 parts of the acrylate based polymer.

Other additives commonly used in the production of binders for these nonwoven mats may optionally be used herein. Such additives include ionic crosslinking agents, thermosetting resins, thickeners, flame retardants and the like.

While the discussion above has been primarily directed to polyester mats for use as roofing membranes, the binders of the invention are equally applicable in the production of other nonwoven products including polyester, felt or rayon mats to be used as a backing for vinyl flooring where the vinyl is processed at high temperatures so that some heat resistance in the binder is required. Similarly, cellulosic wood pulp filters for filtering hot liquids and gases require heat resistant binders such as are disclosed herein.

The following examples are given to illustrate the present invention, but it will be understood that they are intended to be illustrative only and not limitative of the invention. In the examples, all parts are by weight and all temperatures in degrees Celsius unless otherwise noted.

EXAMPLE I

This example illustrates the use of a batch polymerization process to prepare the ethylene vinyl acetate first stage emulsion polymer followed by a slow-addition of monomer to make the second stage.

A 10 liter stainless steel stirred autoclave reactor equipped with heating/cooling, variable speed stirrer and means of metering monomer and initiator was employed.

To the 10 liter autoclave was charged 1800 g of water, 450 g (of a 20% w/w solution) sodium alkyl aryl polyethylene oxide sulfate (3 mol=° ethylene oxide), 40 g (of a 70% w/w solution in water) alkyl aryl polyethylene oxide (30 moles ethylene oxide), 90 g sodium vinyl sulfonate (25% solution in water), 0.5 g sodium acetate, 5 g (of a 1% solution in water) of ferrous sulfate solution, and 2 g sodium formaldehyde sulfoxylate.

After purging with nitrogen, all the vinyl acetate was added (4000 g), along with 6 g of triallylcyanurate. The reactor was then pressurized with 600 psi ethylene and equilibrated for 15 min. at 50° C.

The polymerization was started by metering in a solution of 15 g tertiary butyl hydroperoxide in 200 g water and 12.5 g of sodium formaldehyde sulfoxylate in 200 g water. The initiators were added at a uniform rate over 5 hours.

Concurrently added with the initiators over a period of 4 hours was an aqueous solution of 500 g of N-methylol acrylamide (48% in water), 1.5 g of sodium acetate in 900 g water.

During the reaction the temperature was controlled at 65° C.–70° C. using jacket cooling. At the end of the batch, the emulsion was transferred to an evacuated vessel (30 L) to remove residual ethylene from the system.

This process produced a polymer composition of 89 ethylene, vinylacetate, N-methylol acrylamide, TAC in a ratio of E/VA/NMA/TAC 15/85/5/0.12 % solids 54.0.

Two second stage polymerizations were followed to produce two final products designated Polymer A and Polymer B.

Slow-Addition Process

A. To a 5L flask which was equipped with stirrer, condenser, thermometer and nitrogen perge was added 1980 g of the latex prepared above. To this was added 525 g of water and 20 g of a 70% solution of alkylaryl polyethylene oxide (30 moles ethylene oxide). This was heated to 55° C. Slow-addition of the following were started over 1½ hrs: (1) A monomer addition of 360 g methyl methacrylate, 12.5 g N-isobutoxy methyl acrylamide and 1 g triallyl cyanurate; (2) 2.9 g of t-butyl hydroperoxide in 50 g water, and 2.9 g sodium formaldehyde sulfoxylate.

During the addition, the temperature was controlled at 65°–70° C. using a water bath. At the end of the additions, the batch was held 45 min. at 70° C. to complete reaction. The final Polymer (A) had the following properties: 49% solids, 3.8 pH, and 520 viscosity.

B. Equilibration Process

To a similar 5L flask was added 1980 g of latex at 54% solids, 525 g of water and 20 g of 70% solution of alkyl aryl polyethylene oxide (30 moles E). The batch was heated to 50° C.

The following monomer solution was added over 15 min: 360 g methyl methacrylate; 12.5 g isobutoxy methyl acrylamide; and 1 g triallyl cyanurate. This was allowed to mix and equilibrate for 1½ hrs.

A slow addition of 2.9 t-butyl hydroperoxide in 50 g water, and an addition of 2.9 g sodium formaldehyde sulfoxylate in 50 g of water were started over 1½ hrs. The temperature was maintained at 65°–70° C. At the end of the addition the reaction was held 45 min. at 70° C. to complete the reaction.

EXAMPLE II

This Example illustrates the preparation of the base or first stage polymer using a conventional slow addition process.

A 10 liter stainless steel stirred autoclave reactor equipped with heating/cooling, variable speed stirrer and means of metering monomers and initiators was used.

To the 10 liter autoclave was charged 1800 g of water, 50g (of a 20% w/w solution) of sodium alkylaryl polyethylene oxide sulfate (3 moles EO), 30g (of a 70% w/w solution in water) alkyl aryl polyethylene oxide (30 moles of ethylene oxide), 45g sodium vinyl sulfonate (25% solution in water, 0.5g sodium acetate, 5g (of a 1% solution in water) of ferrous sulfate solution, and 2g sodium formaldehyde sulfoxylate.

After purging with nitrogen 400g of vinyl acetate was added. The reactor was then pressurized with 600 psi ethylene and equilibrated for 15 min. at 50° C.

The polymerization was started by metering in a solution of 18g tertiary butyl hydroperoxide in 200g water and 15g sodium formaldehyde sulfoxylate in 200g water. The initiators were added over a uniform rate over 4½ hrs.

Fifteen minutes after initiating the reaction, an addition of a pre-emulsion of 600g water, 600g (of a 20% w/w solution) of sodium alkylaryl polyethylene oxide sulfate (3 moles EO), 70g (of a 70% solution) of alkyl aryl polyethylene oxide (30 moles EO), 2.5g sodium acetate, 500g of N-methylol acrylamide (48% solution in water), 3600g vinyl acetate and 6g of triallyl cyanurate was started. This was added over 4 hrs.

The reaction temperature was maintained at 70°–75° C. using jacket cooling.

At the end of the batch, the emulsion was transferred to an evacuated vessel (30L) to remove residual ethylene from the system.

A latex with a polymer composition of ethylene/vinyl acetate/N-methylol acrylamide/triallyl cyanurate was produced in a ratio of 15/85/5/0.12.

Latex data were:

53.5% solids 4.0 pH 600 cps viscosity

The second stage polymers may then be prepared using the procedures of Example IA or IB.

EXAMPLE III

Using the procedure(s) in Example I, a series of two-stage emulsion polymers were prepared. The compositions of the first and second stages as well as the polymerization procedures (EQ=equilibration; SA=slow addition) are presented in Table I. Table I also shows the results obtained when the emulsion polymers were tested as heat-resistant binders for non-woven applications.

In order to evaluate the heat resistance of the binders prepared herein, a Thermomechanical Analyzer was employed. The Thermomechanical Analyzer measures dimensional changes in a sample as a function of temperature. In general, the heat resistance is measured by physical dimensional changes of a polymer film as a function of temperature which is then recorded in a chart with temperature along the abscissa and change in linear dimension as the ordinate. Higher dimensional change in the samples represents lower heat resistance. The initial inflection is interpreted as the thermomechanical glass transition temperature (Tg) of the polymer. Samples were prepared for testing on the Analyzer by casting films of the binders on Teflon coated metal plates with a 20 mil. applicator. The dimensional changes in millimeters at two specific intervals, were recorded and are presented as Delta L Extension at 100° C. and 200° C. in Table I.

TABLE I

| POLYMER NUMBER | COMPOSITIONS FIRST STAGE Tg | SECOND STAGE | 1st:2nd RATIO | S/A or EQ | ΔL VALUES @100° C. | @200° C. |
|---|---|---|---|---|---|---|
| 1 | 0° C. EVA/NMA | — | N/A | — | 2.000 | — |
| 2 | 0° C. EVA/NMA/TAC | — | N/A | — | 2.000 | — |
| 3 | −10° C. EVA/NMA | 90ST/10BA/3.5iBMA | 5:1 | EQ | 1.498 | 2.000 |
| 4 | −10° C. EVA/NMA | 90ST/10BA/3iBMA/1TMPTA | 5:1 | EQ | 1.201 | 1.639 |
| 5 | 0° C. EVA/MNA/TAC | 90MMA/10BA/3iBMA/0.5 TMPTA | 4:1 | EQ | .303 | .550 |
| 6 | 0° C. EVA/NMA/DAM | 90MMA/10BA/2NMA/2iBMA/0.8 TMPTA | 3:1 | EQ | .683 | 1.190 |
| 7 | 0° C. EVA/NMA | 93ST/7BA/0.15DAM | 3:1 | EQ | .750 | 1.350 |
| 8 | 0° C. EVA/NMA | 93ST/7BA/0.15DAM | 3:1 | SA | .717 | 1.133 |
| 9 | 0° C. EVA/NMA/TAC | 93ST/7BA/0.15DAM | 3:1 | EQ | .367 | .650 |
| 10 | 0° C. EVA/NMA/TAC | 93ST/7BA/0.15DAM | 3:1 | SA | .317 | .533 |
| 11 | +10° C. EVA/NMA/TAC | 100MMA/3iBMA/0.33TAC | 4:1 | SA | .204 | .447 |
| 12 | 0° C. EVA/NMA/TAC | 100MMA/3iBMA/0.33TAC | 4:1 | EQ | .269 | .543 |
| 13 | 0° C. EVA/NMA/TAC | 100MMA/3iBMA/0.33TAC | 4:1 | SA | .306 | .577 |
| 14 | 0° C. EVA/NMA/TAC | 100MMA/3NMA/0.33TAC | 4:1 | SA | .439 | .687 |
| 15 | 0° C. EVA/NMA/TAC | 100ST/3iBMA/0.33TAC | 4:1 | EQ | .359 | .804 |
| 16 | −7° C. EVA/NMA/TAC | 100MMA/3iBMA/0.33TAC | 3:1 | SA | .355 | .619 |
| 17 | −7° C. EVA/NMA/TAC | 100MMA/3iBMA/0.33TAC | 3:1 | SA | .331 | .591 |
| 18 | −7° C. EVA/NMA/TAC | 100MMA/3iBMA/0.33TAC | 3:1 | SA | .329 | .624 |
| 19 | −7° C. EVA/NMA/TAC | 100MMA/3iBMA/0.33TAC | 3.5:1 | SA | .338 | .632 |
| 20 | −2° C. EVA/NMA/TAC | 100MMA/3iBMA/0.33TAC | 5:1 | SA | .405 | .742 |
| 21 | −2° C. EVA/NMA/TAC | 100MMA/3iBMA/0.33TAC | 5:1 | SA | .376 | .686 |
| 22 | −2° C. EVA/NMA/TAC | 100MMA/3iBMA/0.33TAC | 2.8:1 | SA | .341 | .561 |

TABLE I-continued

| POLYMER NUMBER | COMPOSITIONS FIRST STAGE Tg | SECOND STAGE | 1st:2nd RATIO | S/A or EQ | ΔL VALUES @100° C. | @200° C. |
|---|---|---|---|---|---|---|
| 23 | −2° C. EVA/NMA/TAC | 100MMA/3iBMA/0.33TAC | 2.5:1 | SA | .255 | .479 |
| 24 | 80VA/20BA/3NMA/.12TAC | 100MMA/3iBMA/0.33TAC | 4:1 | SA | .652 | .874 |
| 25 | Rohm & Haas TR 407* | N/A | — | | .339 | .647 |

EVA = Ethylene vinyl acetate
NMA = N-methylol acrylamide
HPMA = Hydroxypropyl methacrylate
MAA = Methacrylic acid
TMPTA = Trimethylol propane triacrylate
TAC = Triallyl cyanurate
DAM = Diallyl maleate
MMA = Methyl methacrylate
iBMA = Isobutyoxy methylacrylamide
BA = Butyl acrylate
VA = Vinyl acetate
*Competitive all-acrylic product used in areas where heat resistance is required.

Emulsion 1 and 2 illustrate that the standard ethylene vinyl acetate copolymer both with and without latent and active crosslinking do not give satisfactory heat resistance performance. Emulsions 3, 4, 7, and 8 show only marginal improvement in heat resistance obtained by the addition of pre-crosslinking monomers to the second stage.

In contrast, Emulsion 5, 6, and 9 thru 23, illustrate the superior heat resistance values obtained utilizing the binders of the present invention wherein pre- and post-crosslinking monomers are present in both stages of the polymer emulsion. In greater detail, these examples illustrate that satisfactory results can be obtained by using either slow addition or equilibration techniques as well as by using a variety of monomers so as to produce a range of Tg's in the first and second stage polymers and various ratios thereof.

It will apparent that various changes and modifications may be made in the embodiments of the invention described above, without departing from the scope of the invention, as defined in the appended claims, and it is intended therefore, that all matter obtained in the foregoing description shall be interpreted as illustrative only and not as limitative of the invention.

We claim:

1. A process for preparing a heat resistant nonwoven product comprising the steps of:

(a) impregnating a nonwoven web with an emulsion polymer having a glass transition temperature (Tg) of +10 to +50° C., said polymer being prepared from a two stage polymerization procedure comprising, as a first stage polymer, an ethylene vinyl acetate polymer having a Tg within the range of −10 to +15° C., and a second stage polymer having a Tg of +50 to +120° C., both of said first and second stage polymers containing polymerized therein a pre-crosslinking monomer selected from the group consisting of ethylene glycol diacrylate, 1,3-butylene glycol diacrylate, propylene glycol diacrylate, triethylene glycol dimethacrylate, 1,3-glycerol dimethacrylate, 1,1,1-trimethylol propane dimethacrylate, 1,1,1-trimethylol ethane diacrylate, pentaerythritol trimethacrylate, sorbitol pentamethacrylate, methylenebisacrylamide, methylene bismethacrylamide, divinyl denzene, vinyl methacrylate, vinyl crotonate, vinyl acrylate, divinyl adipate, triallyl cyanurate, triallyl isocyanurate, diallyl phthalate, allyl methacrylate, allyl acrylate, diallyl maleate, diallyl fumarate, diallyl itaconate, diallyl malonate, diallyl carbonate, triallyl citrate, triallyl aconitate, divinyl ether, and ethylene glycol divinyl ether and a post-crosslinking monomer selected from the group consisting of N-alkylolamides of alpha, beta ethylenically unsaturated carboxylic acids having 3–10 carbons, the N-alkylol amides of the vinyl aromatic acids, N-(alkoxyl methyl) acrylates and methacrylates, where the alkyl group has from 1–8 carbon atoms and mixtures of these monomers with allyl carbamate, acrylamide or methacrylamide, with the ratio of the first polymer to the second polymer varying within a range of 6 to 1 to 2 to 1;

(b) removing excess binder;

(c) drying and curing the mat.

2. The process of claim 1 wherein the web is cured by heating at a temperature of at least about 150° C.

3. The process of claim 1 wherein the web is cured by catalysis.

4. The process of claim 1 wherein the second stage polymer contains as a major constituent monomers of $C_1$–$C_4$ alkyl acrylates or methacrylates.

5. The process of claim 1 wherein the pre-crosslinking monomer is present in an amount of 0.01 to 0.5 percent by weight.

6. The process of claim 5 wherein the pre-crosslinking monomer is present in an amount of 0.05 to 0.25 percent by weight.

7. The process of claim 1 wherein the post-crosslinking monomer is present in an amount of 0.5 to 10 percent by weight.

8. The process of claim 7 wherein the post-crosslinking monomer is present in an amount of 2 to 6 percent by weight.

9. The process of claim 1 wherein the ratio of the first stage polymer to second stage polymer is 3 to 1.

10. The process of claim 1 wherein post-crosslinking monomer is N-methylol acrylamide or N-methylol methacrylamide.

11. The process of claim 1 wherein the pre-crosslinking monomer is triallyl cyanurate.

12. The process of claim 1 wherein there is additionally present in the emulsion polymer up to 4 parts by weight of an alkenoic or alkenedioic acid having from 3 to 6 carbon atoms.

13. The process of claim 1 wherein the nonwoven web is selected from the group consisting of polyester, felt, rayon or cellulose wood pulp.

14. The process of claim 1 wherein the nonwoven web is polyester.

15. An asphalt coated roofing membrane comprising a polyester mat impregnated with an emulsion polymer being prepared from a two stage polymerization procedure comprising, as a first stage polymer, an ethylene vinyl acetate polymer having a Tg within the range of −10 to +15° C., and a second stage polymer having a Tg of +50 to +120° C., both of said first and second stage polymers containing polymerized therein a precrosslinking monomer selected from the group consisting of ethylene glycol diacrylate, 1,3-butylene glycol diacrylate, propylene glycol diacrylate, triethylene glycol dimethacrylate, 1,3-glycerol dimethacrylate, 1,1,1-trimethylol propane dimethacrylate, 1,1,1-trimethylol ethane diacrylate, pentaerythritol trimethacrylate, sorbitol pentamethacrylate, methylenebisacrylamide, methylene bismethacrylamide, divinyl benzene, vinyl methacrylate, vinyl crotonate, vinyl acrylate, divinyl adipate, triallyl cyanurate, triallyl isocyanurate, diallyl phthalate, allyl methacrylate, allyl acrylate, diallyl maleate, diallyl fumarate, diallyl itaconate, diallyl malonate, diallyl carbonate, triallyl citrate, triallyl aconitate, divinyl ether, and ethylene glycol divinyl ether and a post-crosslinking monomer selected from the group consisting of N-alkylolamides of alpha, beta ethylenically unsaturated carboxylic acids having 3–10 carbons, the N-alkylol amides of the vinyl aromatic acids, N-(alkoxyl methyl)acrylates and methacrylates, where the alkyl group has from 1–8 carbon atoms and mixtures of these monomers with allyl carbamate, acrylamide or methacrylamide, with the ratio of the first polymer to the second polymer varying within a range of 6 to 1 to 2 to 1; the impregnated mat being subsequently coated with asphalt.

* * * * *